US007765965B2

(12) United States Patent
Pattakos et al.

(10) Patent No.: US 7,765,965 B2
(45) Date of Patent: Aug. 3, 2010

(54) FULLY VARIABLE VALVE ACTUATION

(76) Inventors: Manousos Pattakos, Lampraki 406, P.C. 18452 GR, Nikea Piraeus (GR); John Pattakos, Lampraki 406, P.C. 18452 GR, Nikea Piraeus (GR); Emmanouel Pattakos, Lampraki 406, P.C. 18452 GR, Nikea Piraeus (GR)

( * ) Notice: Subject to any disclaimer, the term of this patent is extended or adjusted under 35 U.S.C. 154(b) by 246 days.

(21) Appl. No.: 11/759,392

(22) Filed: Jun. 7, 2007

(65) Prior Publication Data

US 2008/0302318 A1 Dec. 11, 2008

(51) Int. Cl.
*F01L 1/34* (2006.01)

(52) U.S. Cl. ..... 123/90.16; 123/90.15

(58) Field of Classification Search ..... 123/90.15, 123/90.16

See application file for complete search history.

(56) References Cited

U.S. PATENT DOCUMENTS

2007/0074687 A1 * 4/2007 Bosl-Flierl et al. ..... 123/90.16

* cited by examiner

*Primary Examiner*—Zelalem Eshete

(57) ABSTRACT

A Fully variable mechanical VVA, or FVVA, achieves more than the Lost Motion VVAs and the Constant Duration VVAs can jointly offer, because the FVVA provides the infinite valve lift profiles a Lost Motion VVA can provide, and the infinite valve lift profiles a Constant Duration VVA can provide and infinite more infinities of different valve lift profiles. The FVVA provides an infinity of valve lifts, and each valve lift can be combined to any duration, from infinite available.

4 Claims, 16 Drawing Sheets

FULLY VARIABLE VALVE ACTUATION

The state of the art mechanical Variable Valve Actuation (VVA) systems are either Lost Motion (LMVVA), or Constant Duration (CDVVA). In both types each valve lift, from the infinite available, relates to one, and only one, valve duration.

This invention introduces a new type of VVA, the Fully variable mechanical VVA, or FVVA, which provides more than both existing types can jointly offer, because it provides all the valve lift profiles a LMVVA can provide, and all the valve lift profiles a CDVVA can provide and more than an infinity more combinations of lifts and durations.

A typical LMVVA provides a continuous range of lifts, from a minimum to a maximum, and for each lift there is one, and only one, relative duration, the lower the lift the shorter the duration.

A typical CDVVA provides a continues range of lifts, from a minimum to a maximum, with all lifts being of the same duration.

In the proposed FVVA there is also a continuous range of available lifts, from a minimum to a maximum. The difference is that for every lift there is an infinity of available durations.

Figure 12:
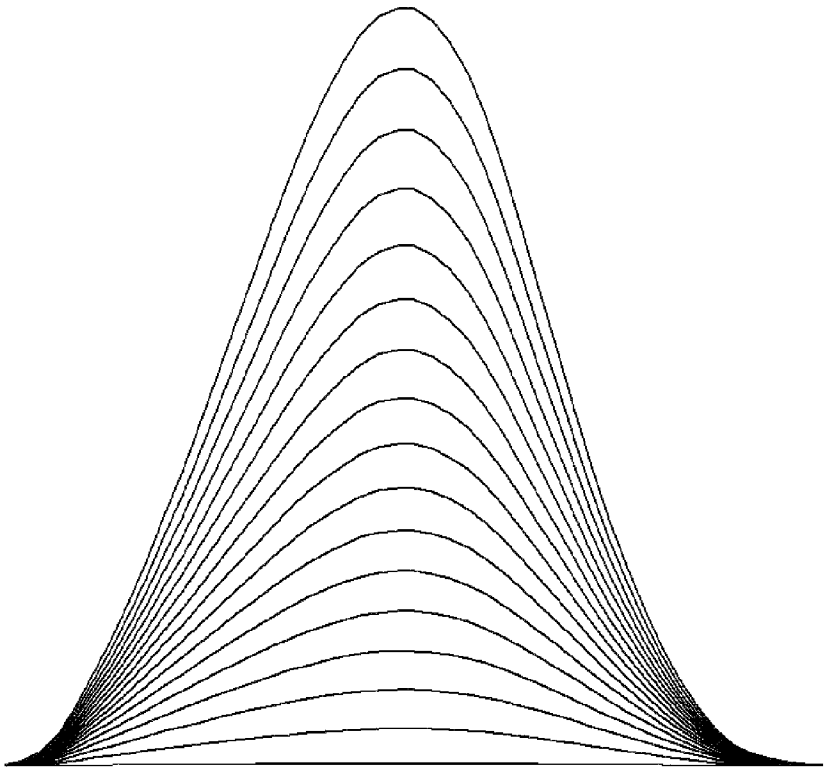
FIG. 12 shows a group of typical constant duration valve lift profiles.
Figure 11:
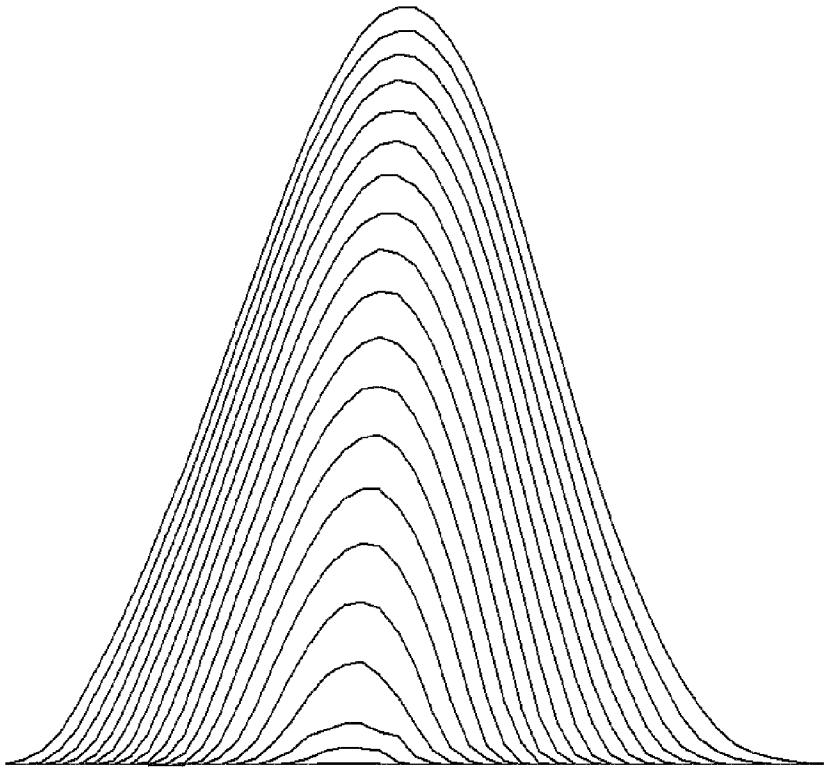
FIG. 11 shows a group of typical lost motion valve lift profiles.
Figure 13:
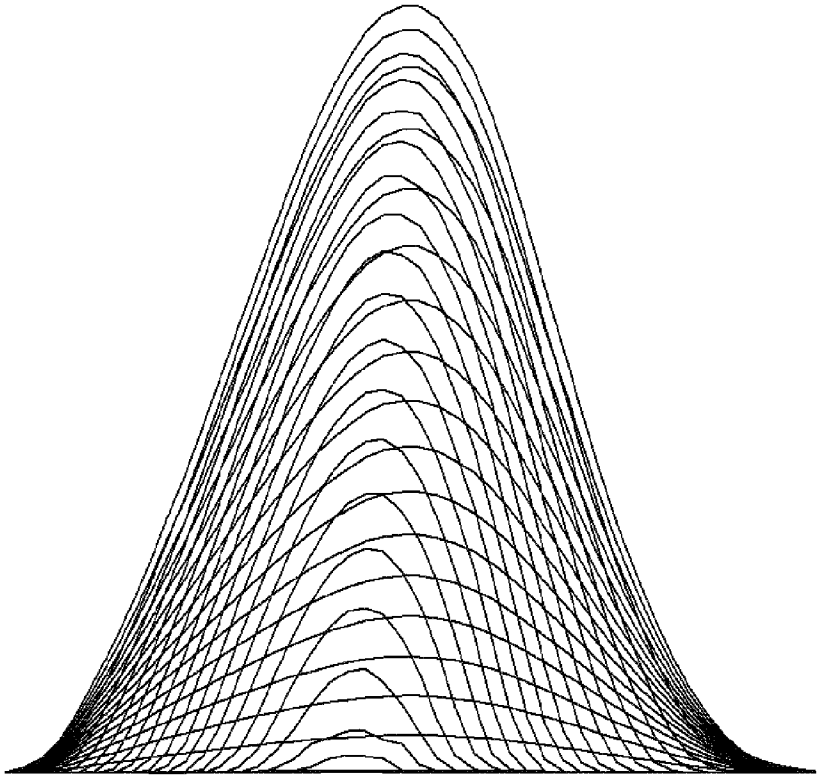

FIG. 13 combines in the same plot the valve lift profiles shown in FIG. 11 and FIG. 12.

Figure 14:
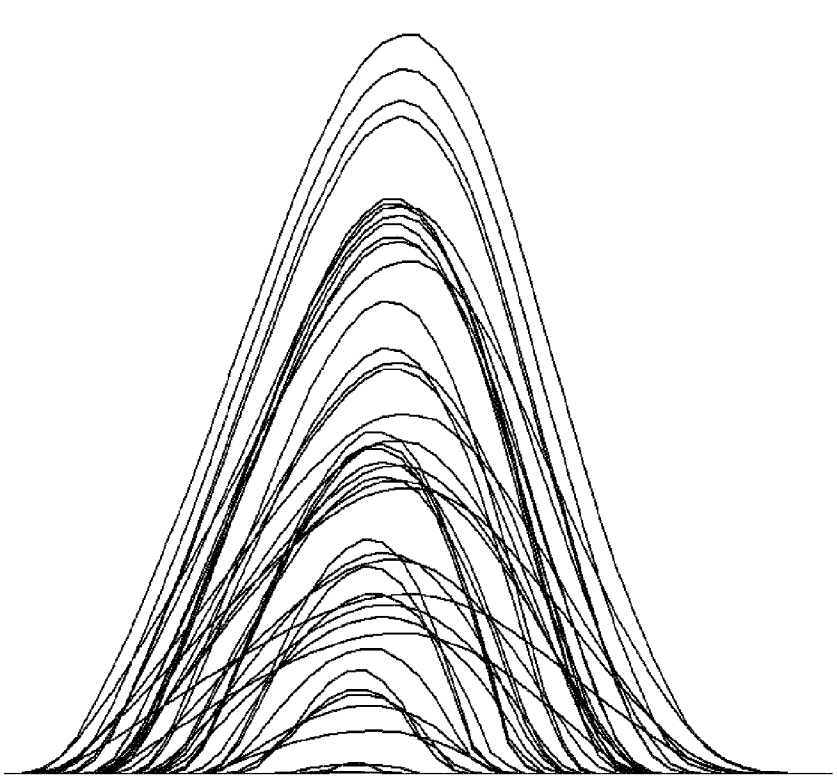

FIG. 14 shows valve lift profiles available with an FVVA system.

Figure 15:
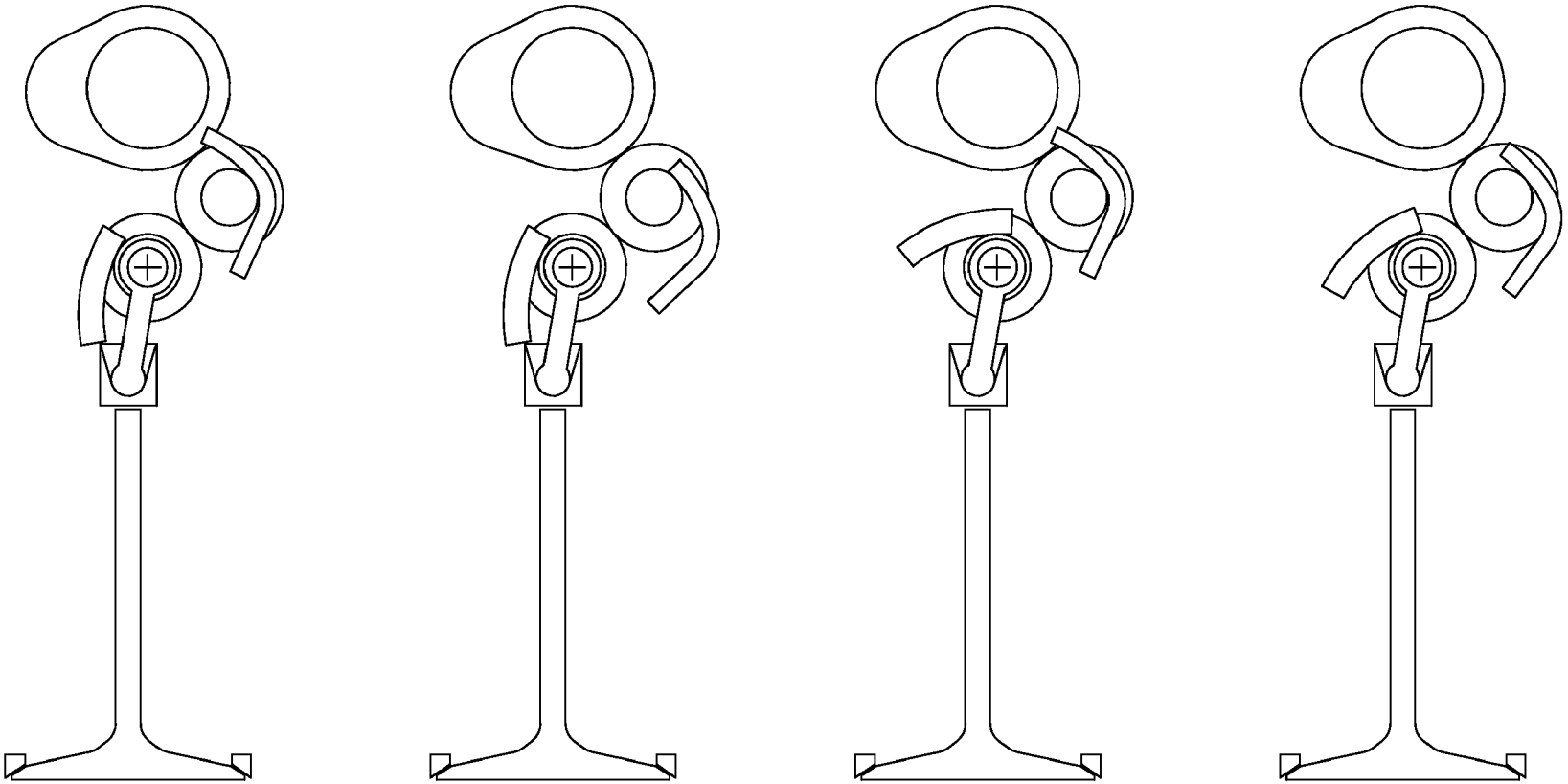

FIG. 15 shows another embodiment of an FVVA, in four different combinations of the rotation angles of the two control shafts.

Figure 16:
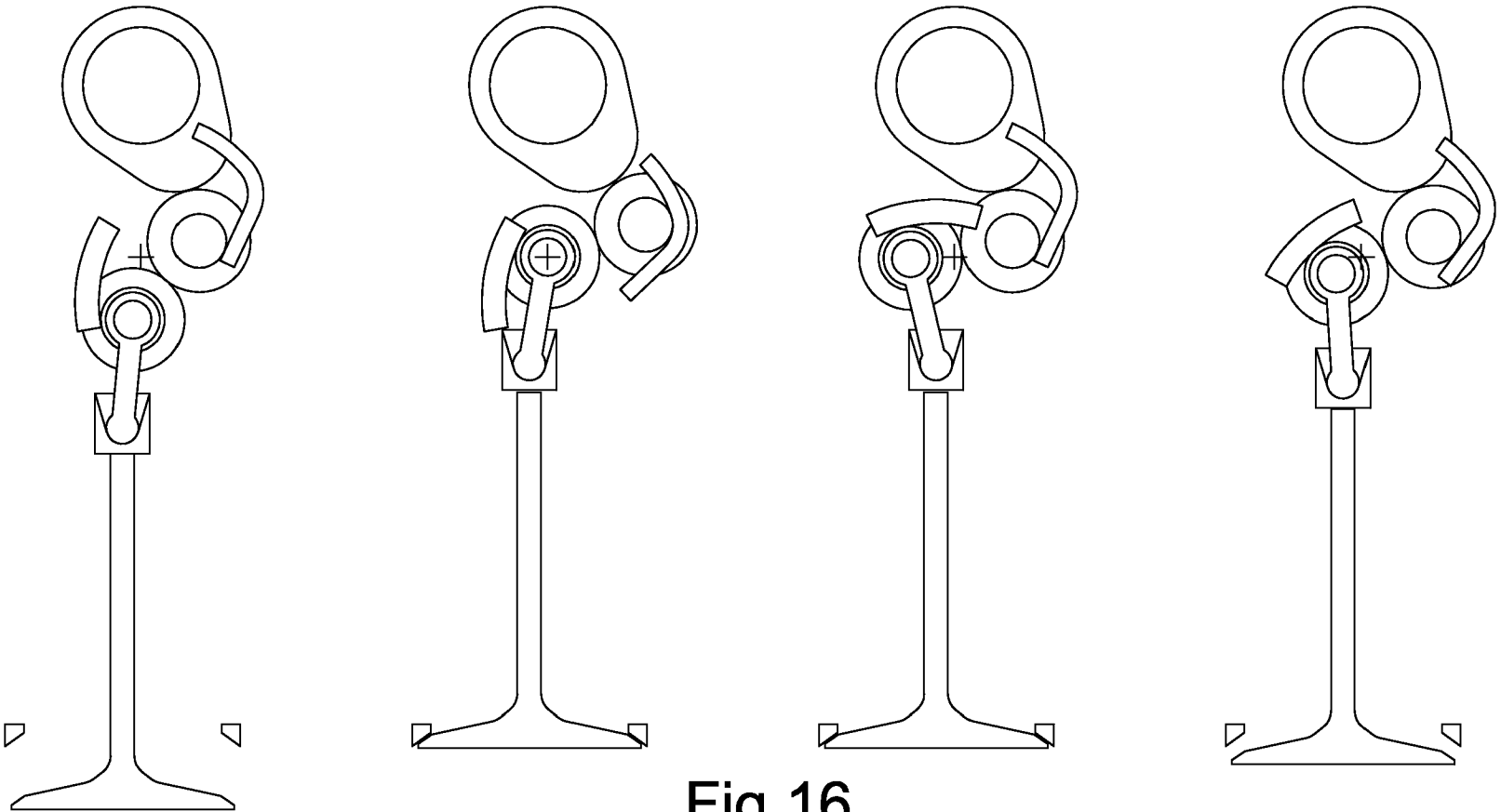

FIG. 16 shows the mechanism shown in FIG. 15, in a different angle of the cam lobe.

Figure 17:
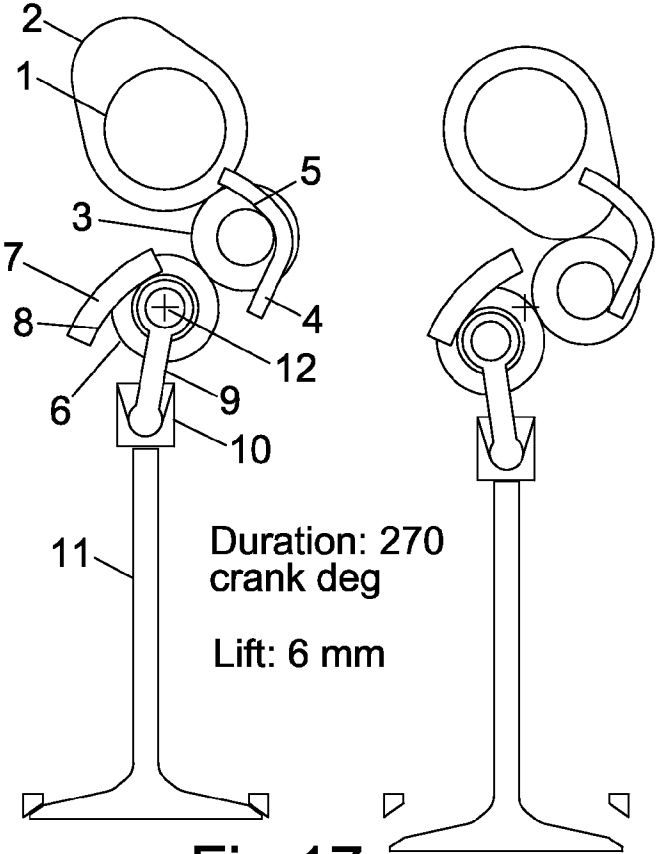

FIG. 17 shows the mechanism of FIG. 15 in a medium lift with long duration mode.

Figure 18:
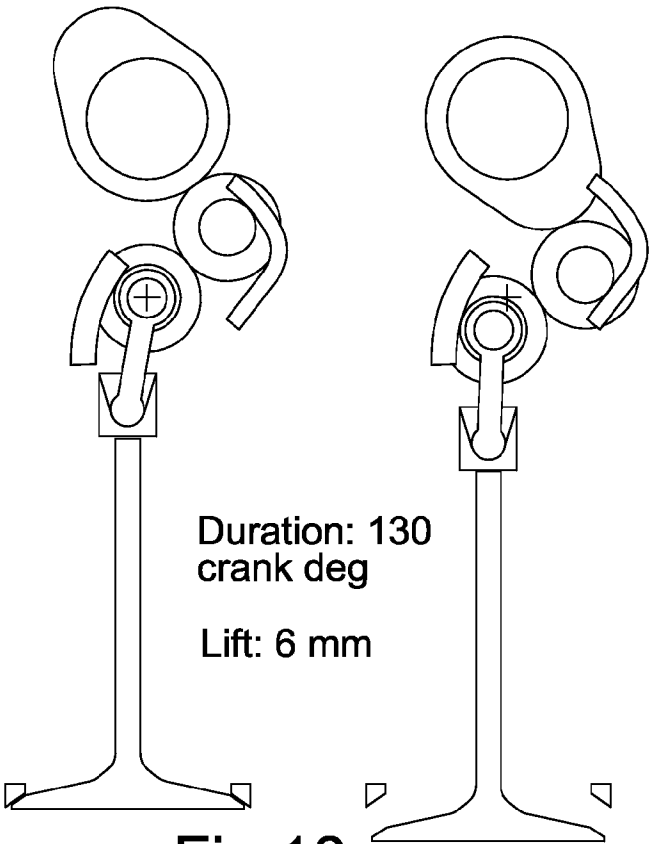

FIG. 18 shows the mechanism of FIG. 15 in a medium lift with short duration mode.

Figure 19:
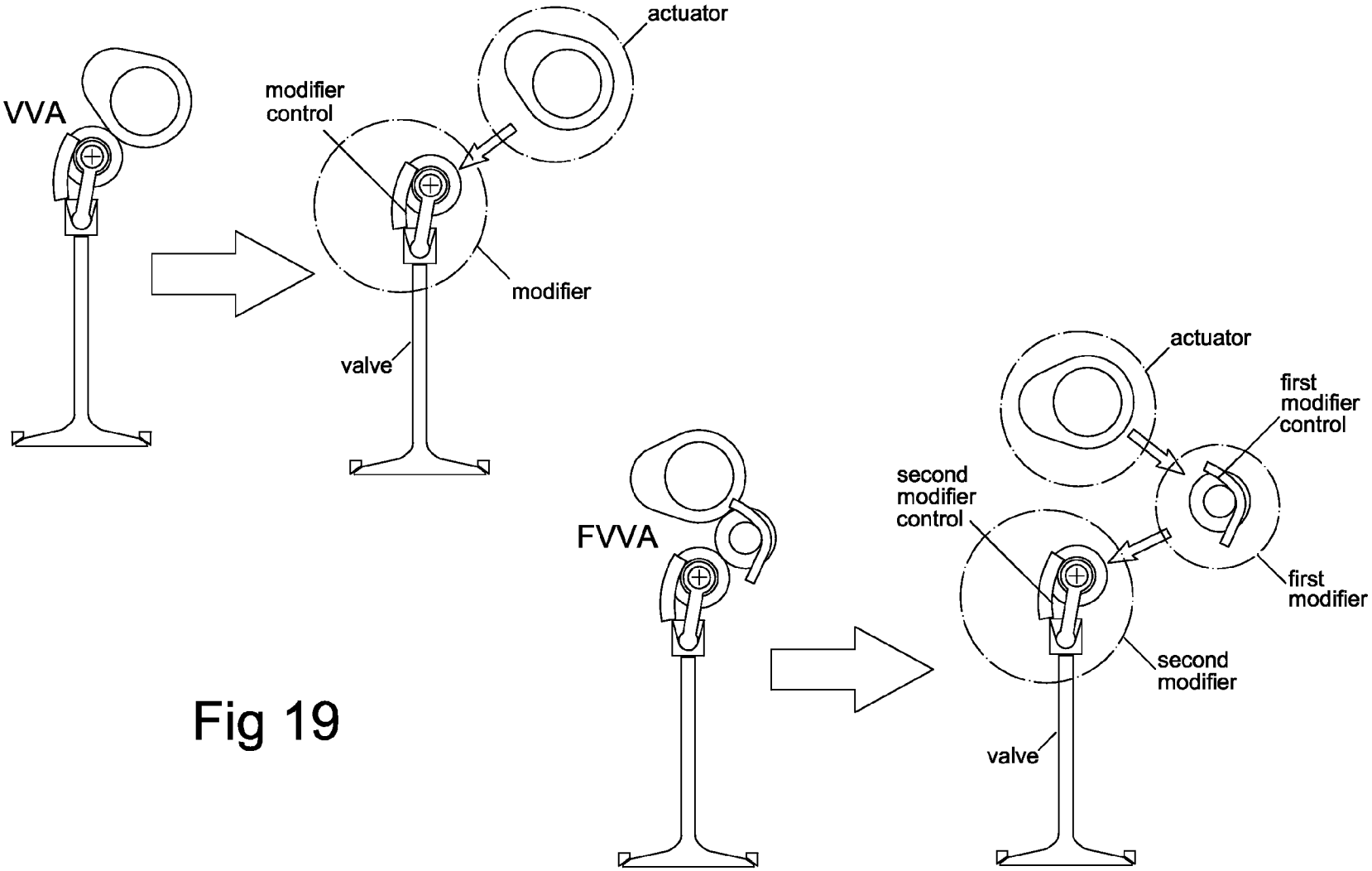

FIG. 19 shows the principle of operation of a typical VVA, up left, and of an FVVA, down right.

Figure 20:
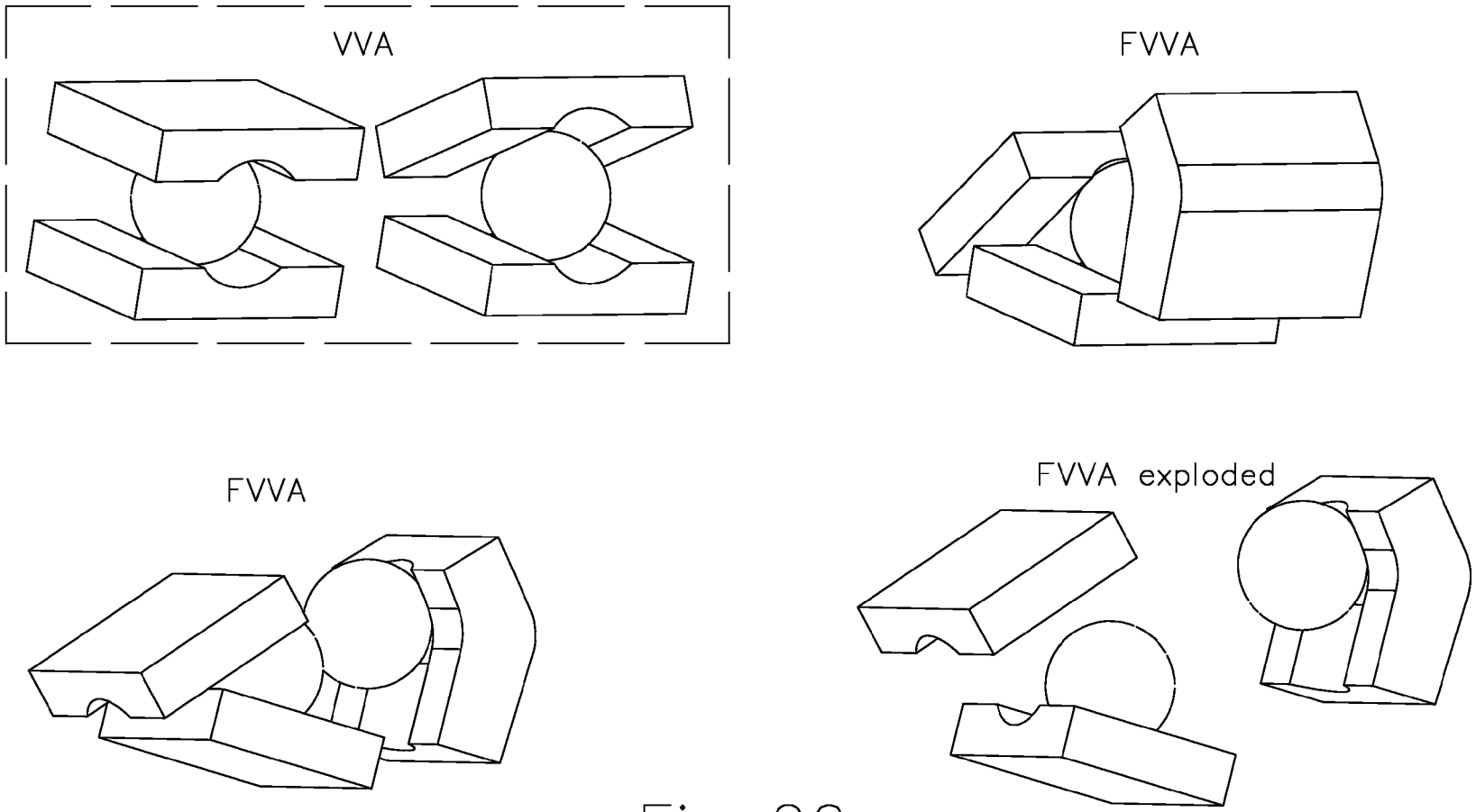

FIG. 20 shows the basic mechanism of a typical VVA and of the relevant FVVA.

Figure 21:
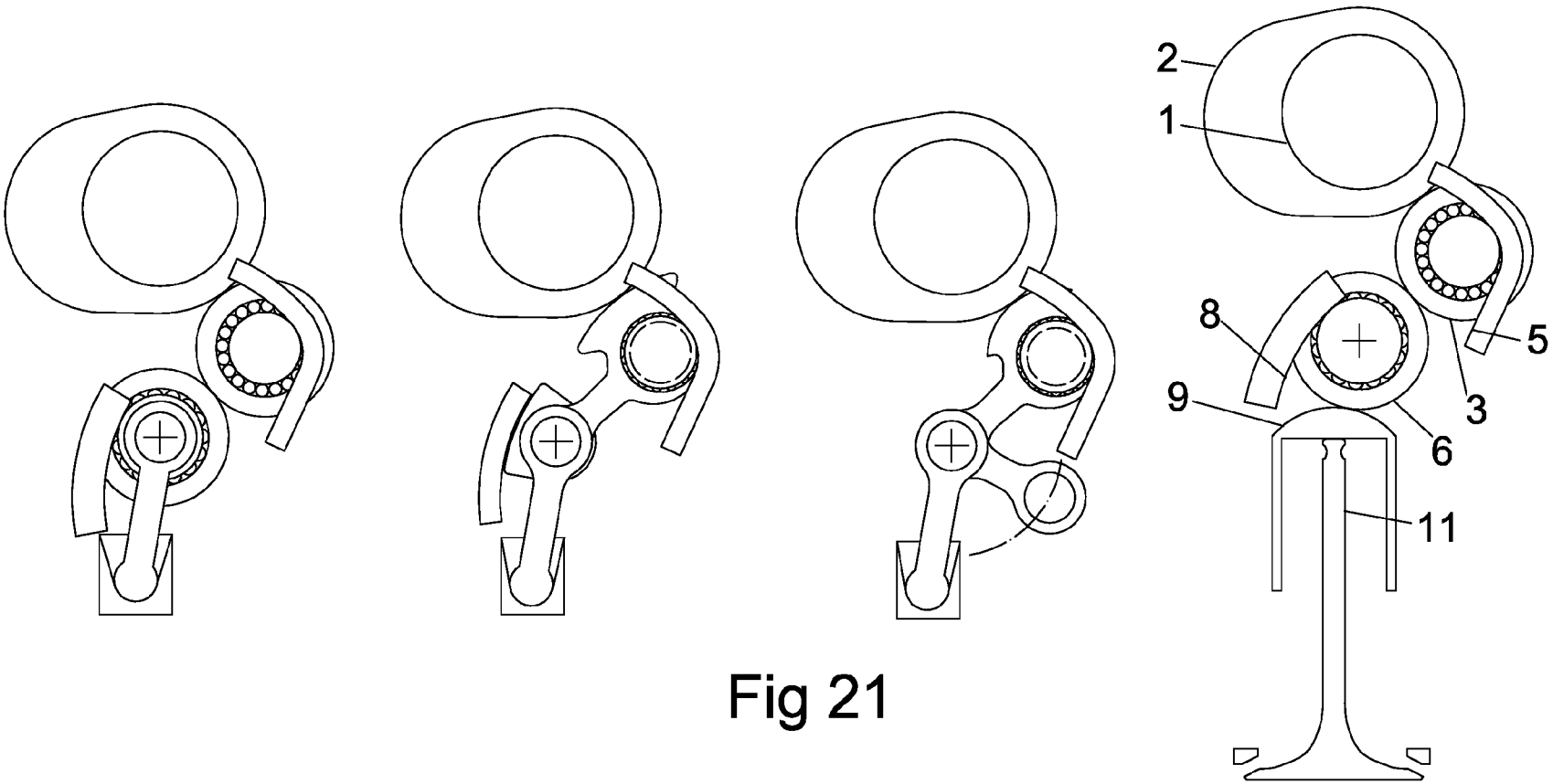

FIG. 21 shows some variations of the FVVA of FIG. 15.

Figure 22:
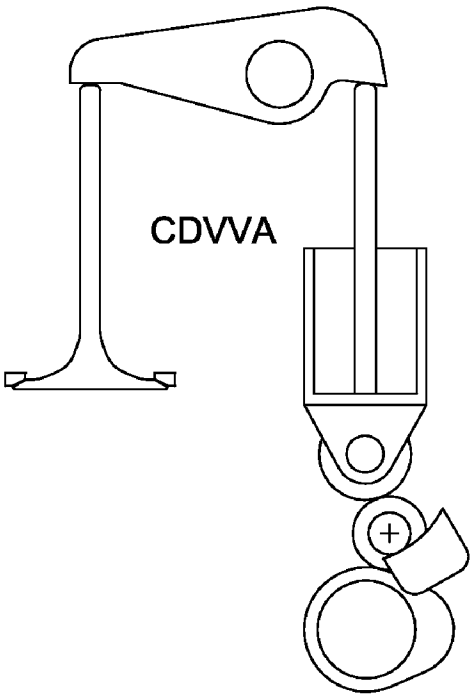

FIG. 22 shows a typical side cam constant duration VVA.

Figure 23:
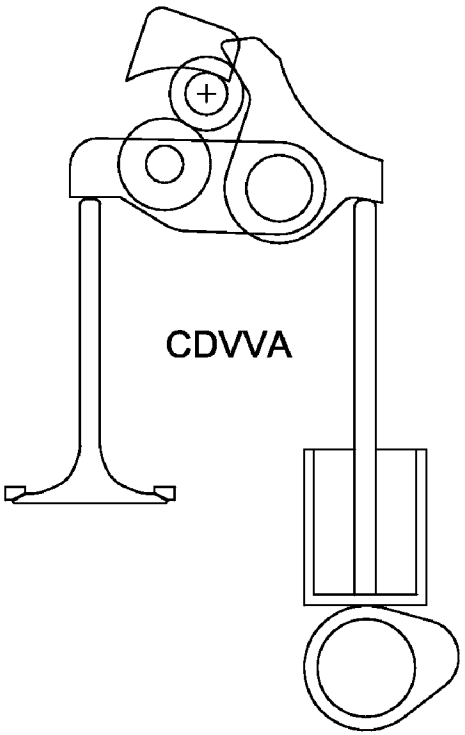

FIG. 23 shows another typical side cam constant duration VVA.

Figure 24:
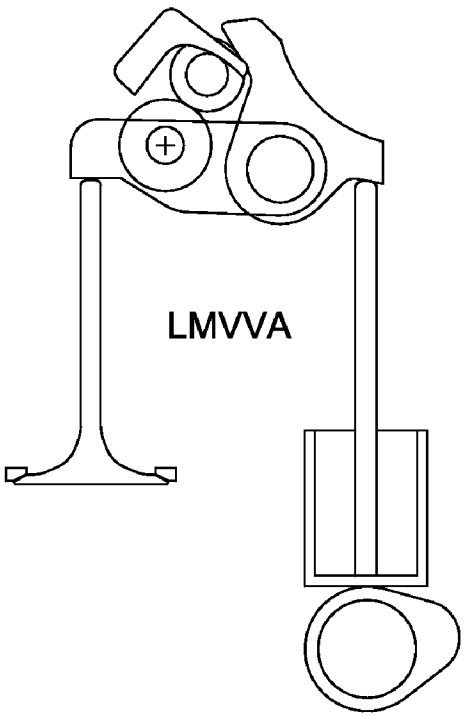

FIG. 24 shows the mechanism of FIG. 23 modified to a lost motion VVA.

Figure 25:
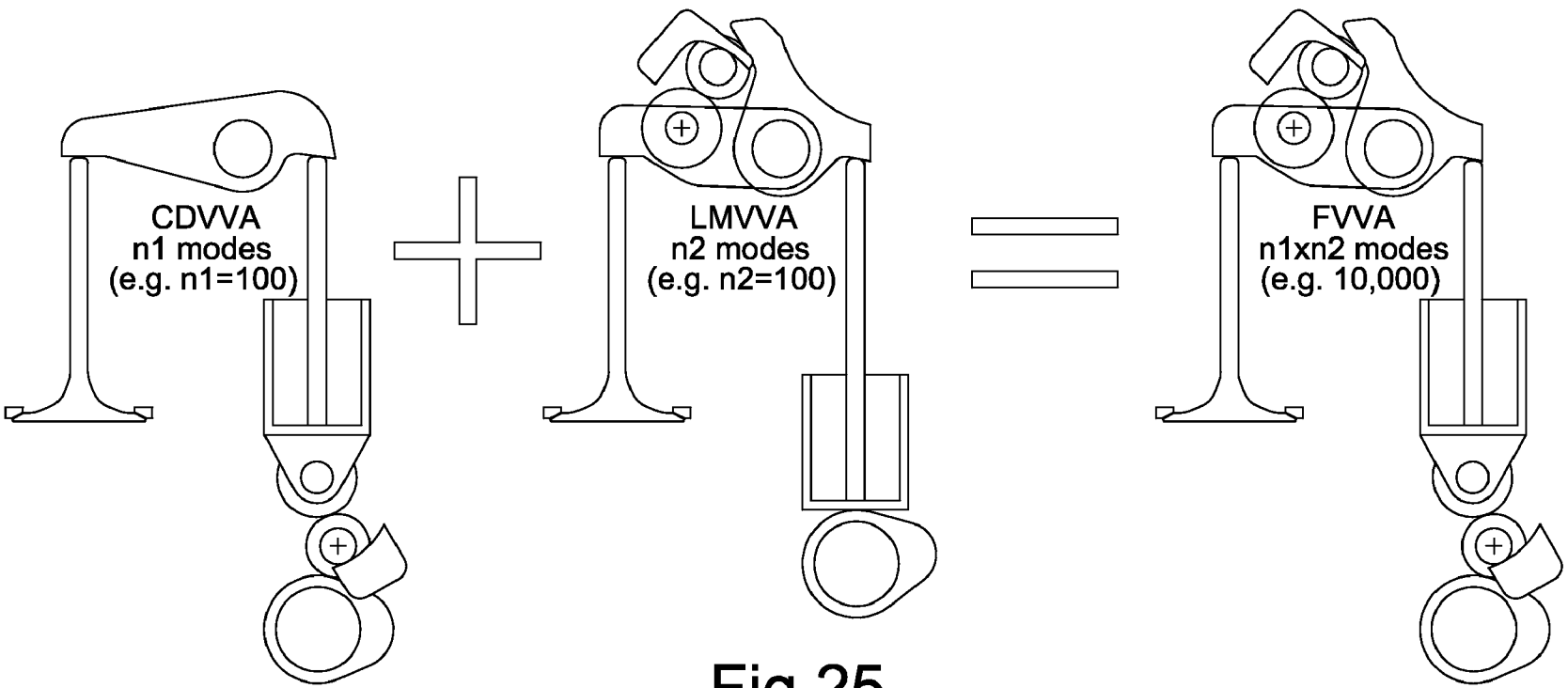

FIG. 25 shows an FVVA resulting from the combination of the parts of the mechanisms shown in FIG. 22 and FIG. 24.

Figure 1:
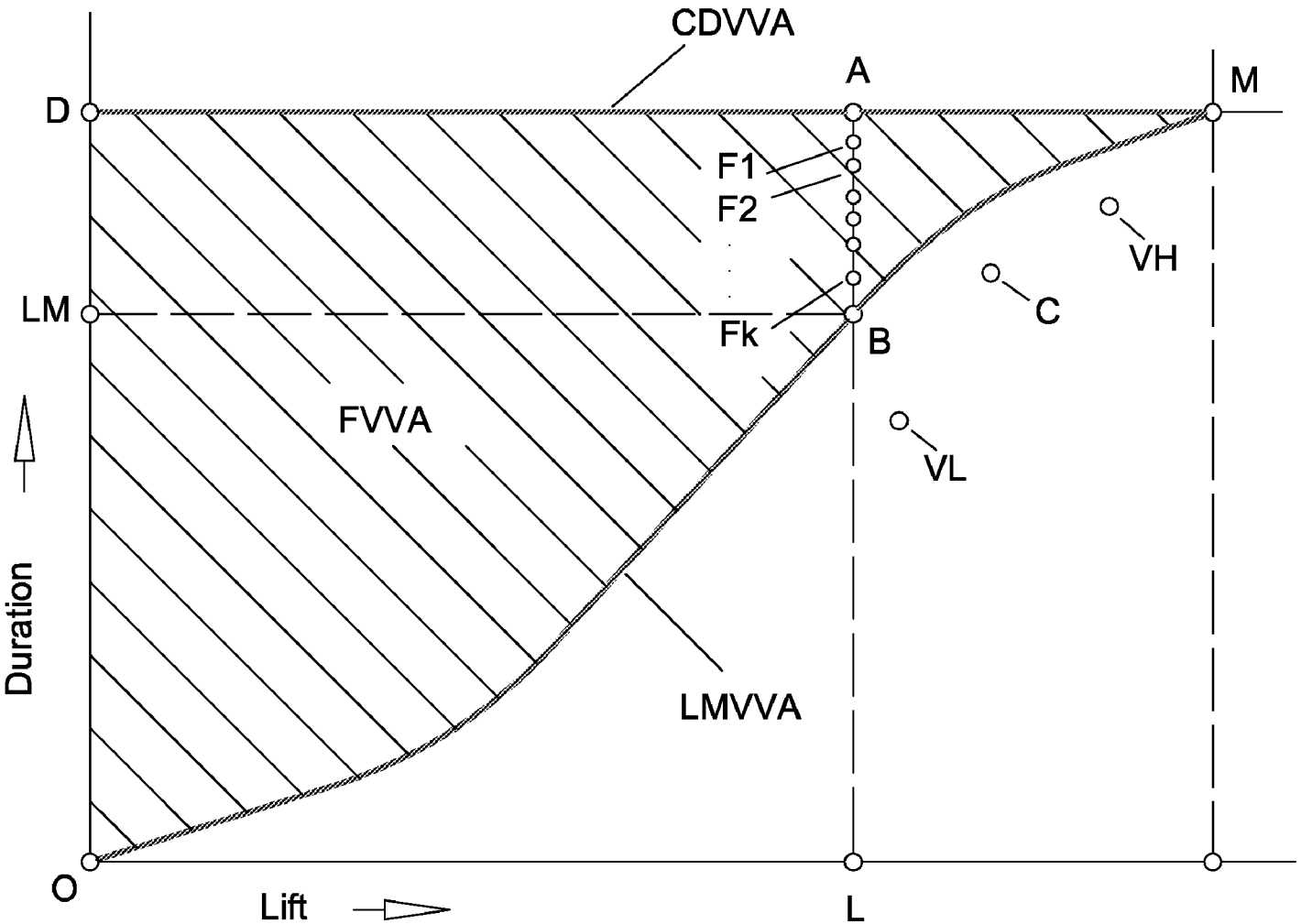
FIG. 1 shows the various valve trains in a lift versus duration plot.

In FIG. 1 the vertical axis is the valve duration and the horizontal axis is the valve lift.

The conventional engine is represented by a single point, like C, because it can provide only one lift and one duration.

An engine with VTEC, a two step VVA, is represented by two different points VL and VH.

A typical LMVVA is represented by a curve starting from zero valve lift-zero duration, at point O, and ending at the maximum lift-maximum duration point M. All the available lift-duration pairs lie on this O-B-M curve and every point on the O-B-M curve is obtainable by the LMVVA, but nothing more.

A typical CDVVA is represented by a horizontal line starting from the vertical axis at D and ending at M. All the available lift-duration pairs lie on this D-A-M horizontal line and every point on the D-A-M horizontal line is attainable by the CDVVA, but nothing more.

In the FVVA the available lift-duration pairs cover not only a curve or line, as happens in LMVVA and in CDVVA, but the whole hatched area enclosed between the vertical axis, the O-B-M curve and the D-A-M horizontal line. Every point into this hatched area is obtainable by the FVVA.

It is said that the LMVVA or the CDVVA provide infinite lift-duration pairs. On this basis the number of lift-duration pairs a FVVA can provide, is infinite square. It is like going from one dimension to two dimensions.

For a specific lift L the LMVVA operates exclusively at the point B where the vertical line from L intersects the O-M curve.

For the same lift L, the CDVVA operates exclusively at the point A where the vertical line from L intersects the horizontal line D-M. For the same lift L, the FVVA can operate at any duration, of the infinite available, between LM and D, i.e. it can operate at any point along the A-B line segment, like the points A, F1, F2, . . . , Fk, B.

Figure 2:
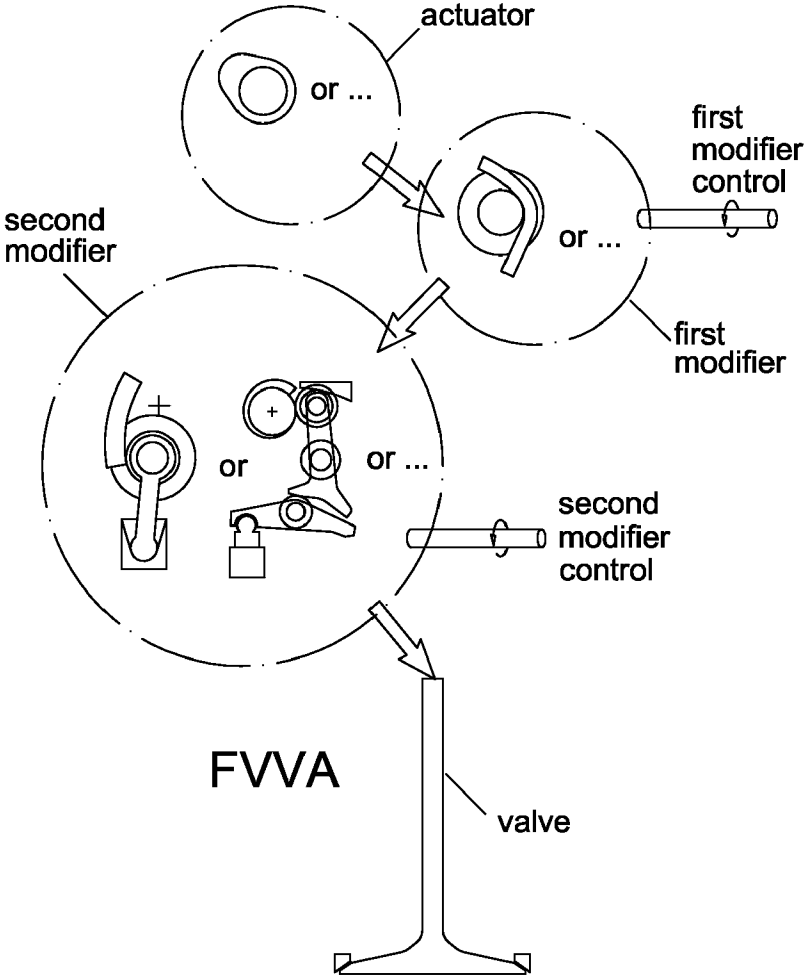
FIG. 2 shows the principle of operation of a FVVA compared to a VVA.
Figure 2:
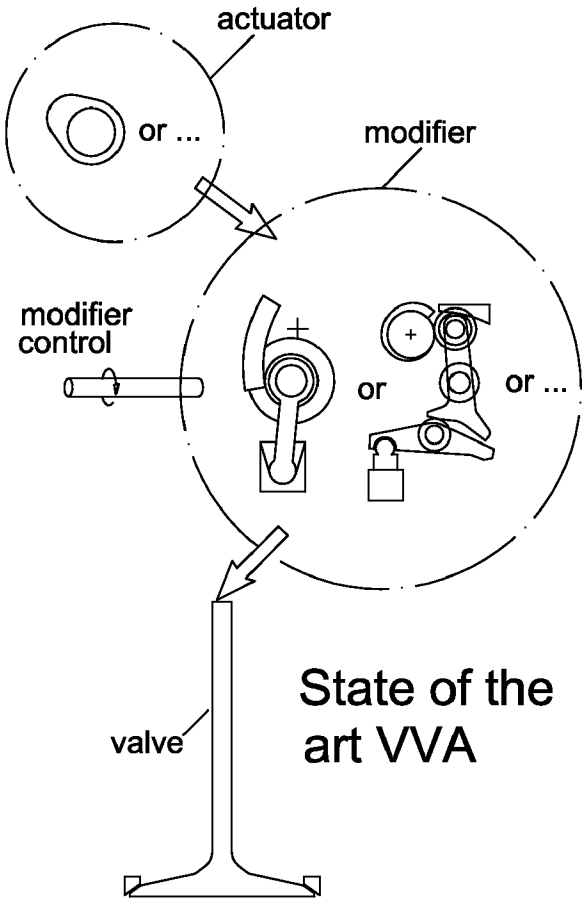

FIG. 2 shows the principle of operation of the conventional VVA and of the FVVA.

Figure 3:
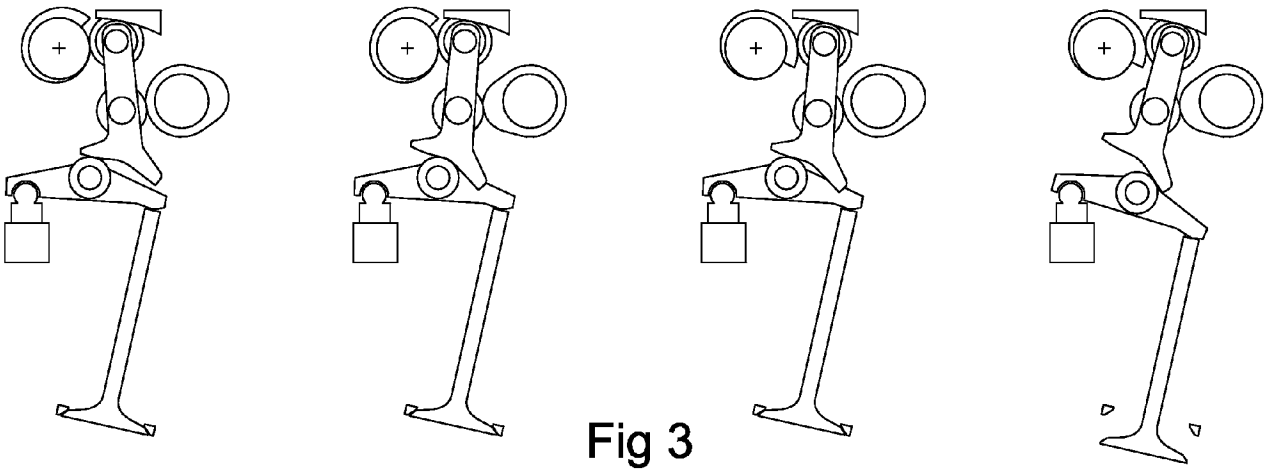
FIG. 3 shows a conventional VVA in low lift mode at left, and in high lift mode at right, for two different camshaft angles for each mode.

FIG. 3 shows a state of the art LMVVA, currently in mass production, disclosed in U.S. Pat. No. 5,373,818 patent. Each valve duration corresponds to one and only one valve lift, as in FIG. 11. The lower the lift, the shorter the duration. The provided combinations of lift-duration cannot be, all, the optimum ones. FIGS. 4 to 10 show the LMVVA of FIG. 3 modified to a FVVA. What is necessary is a roller (20) per cam lobe and a control shaft (21) per row of valves. The control shaft (21) can rotate about the axis (22) and has a cylindrical surface along which the pin of the roller (20) rolls. The roller (20) is trapped between the roller (23) of the lever (24), the cam (25) and the control shaft (21). Depending on the angular position of the control shaft (21) about the axis at the cross (22), the angular oscillation the lever (24) performs varies in amplitude, and depending on the angular position of the original control shafts (26) about the axis at the cross (27), the angular oscillation of the lever (24) translates into variable pushes on the finger follower (28) and to variable valve lift profiles of the valve (29). For each valve duration there is a continuous range of available lifts to choose the best for the existing operational conditions, and vice versa.

Figure 4:
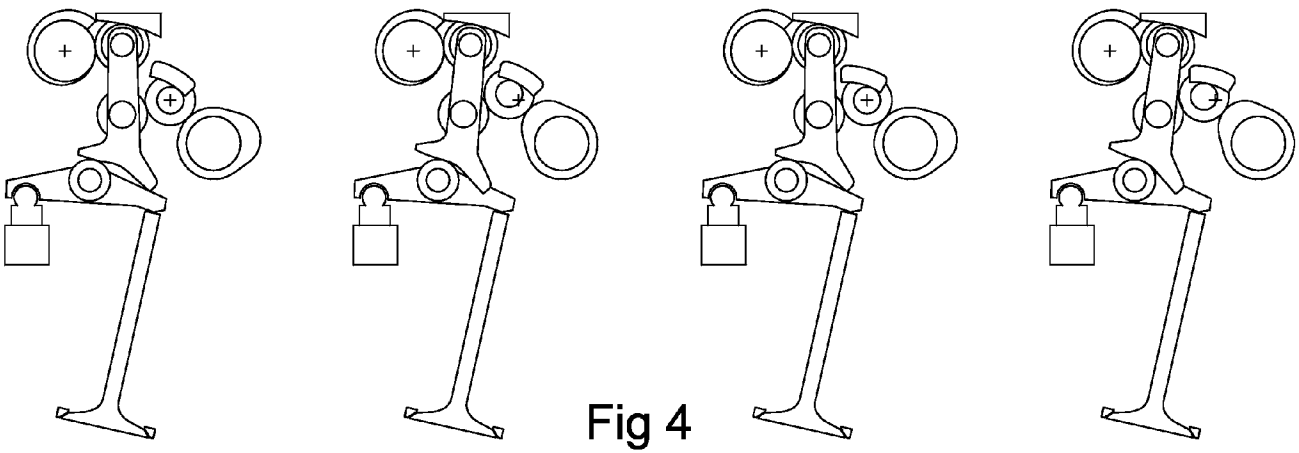
FIG. 4 shows the VVA mechanism of FIG. 3 modified to an FVVA with the addition of a control shaft and of a roller, with the additional control shaft being in a low lift mode at left, and in a high lift mode at right, for two different camshaft angles.
Figure 5:
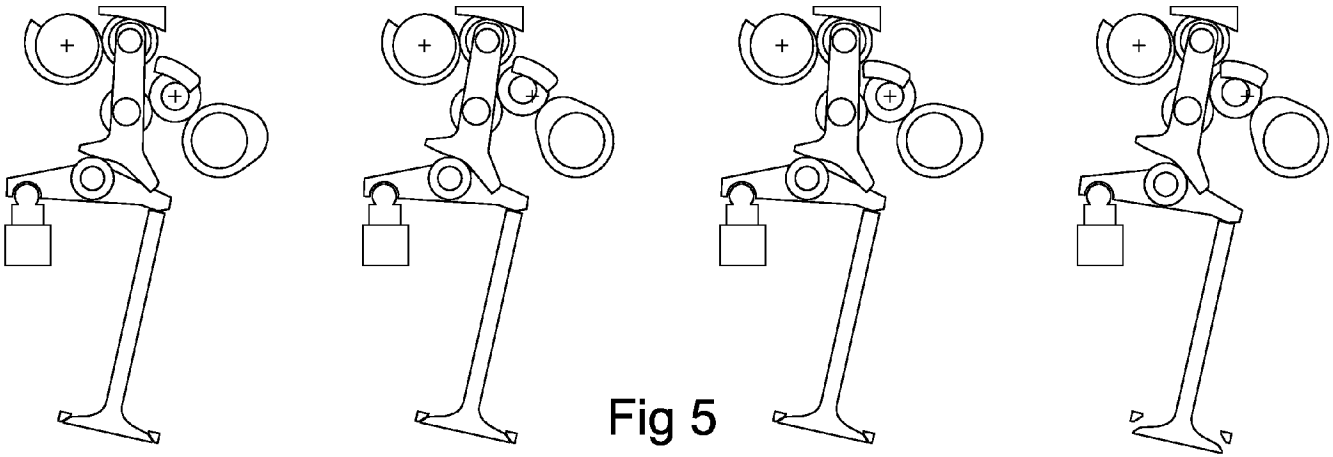
FIG. 5 shows the FVVA mechanism of FIG. 4 with the two control shafts and the cam lobe in various angles.
Figure 6:
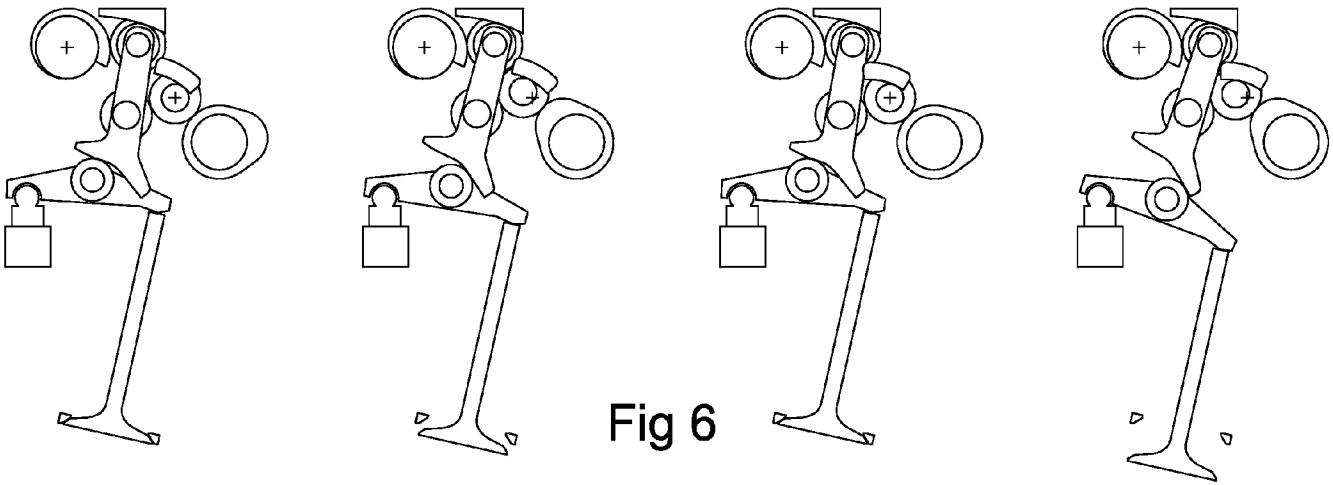
FIG. 6 shows the FVVA mechanism of FIG. 4 with the two control shafts and the cam lobe in various angles.

In FIG. 4 the original control shaft (26) is at an angle providing short duration, in FIG. 5 the original control shaft is at an angle providing intermediate duration and in FIG. 6 the original control shaft is rotated at an angle providing long valve duration. The new control shaft (21) is shown in two different angles, one providing higher valve lift and another providing lower valve lift. The cam (25) is also shown in two different angles.

Figure 8:
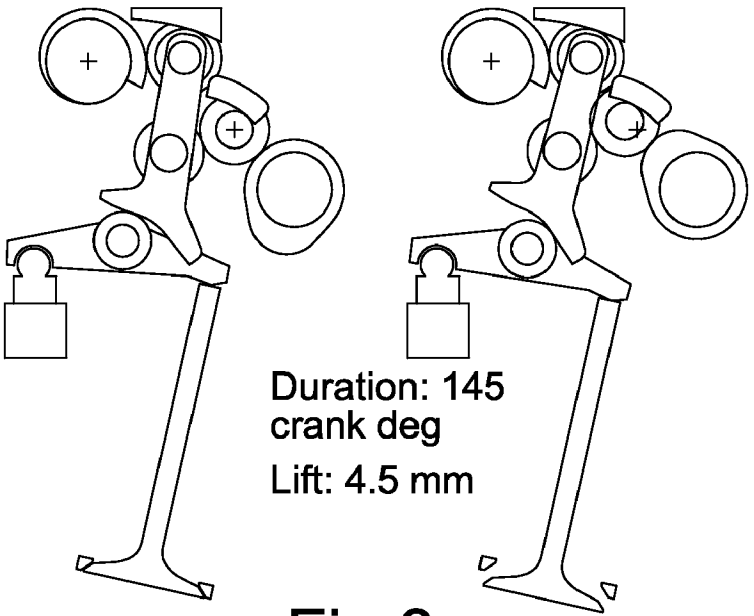
FIG. 8 shows the FVVA mechanism of FIG. 4 with the two control shafts in angles providing specific lift and duration.
Figure 7:
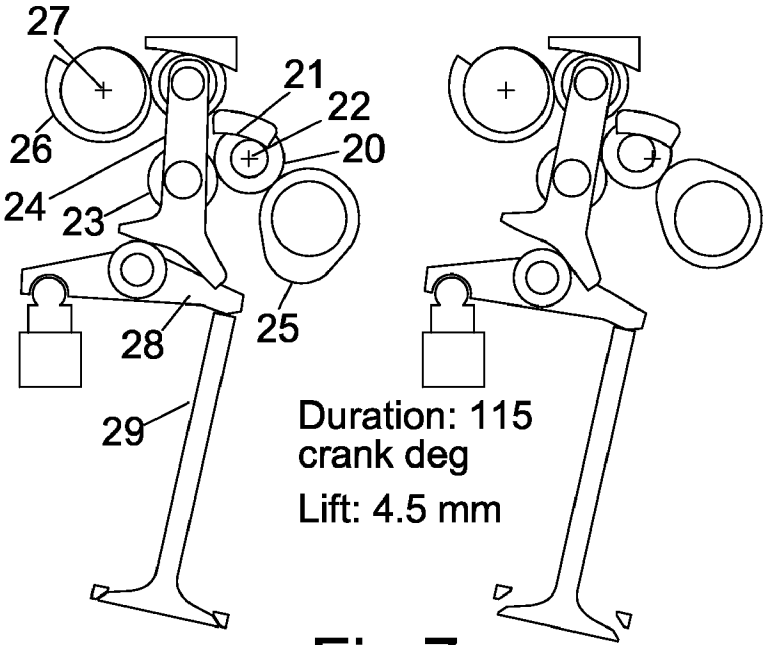
FIG. 7 shows the FVVA mechanism of FIG. 4 with the two control shafts in angles providing specific lift and duration.

In FIGS. 7 and 8 the same valve lift can be achieved by different combinations of the rotation angles of the two control shafts. The duration in FIG. 7 is shorter than in FIG. 8.

Figure 9:
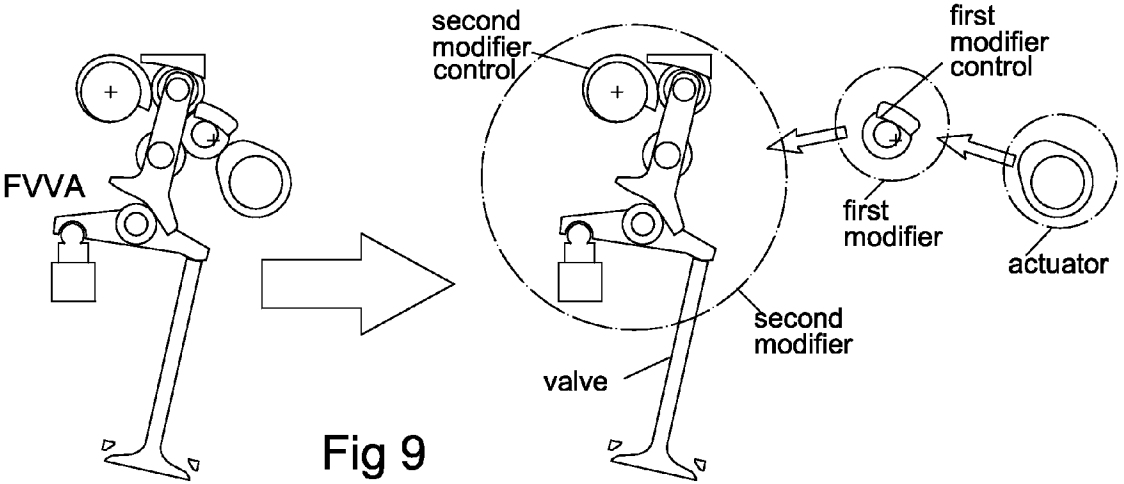
FIG. 9 shows the principle of operation of the FVVA mechanism of FIG. 4.
Figure 10:
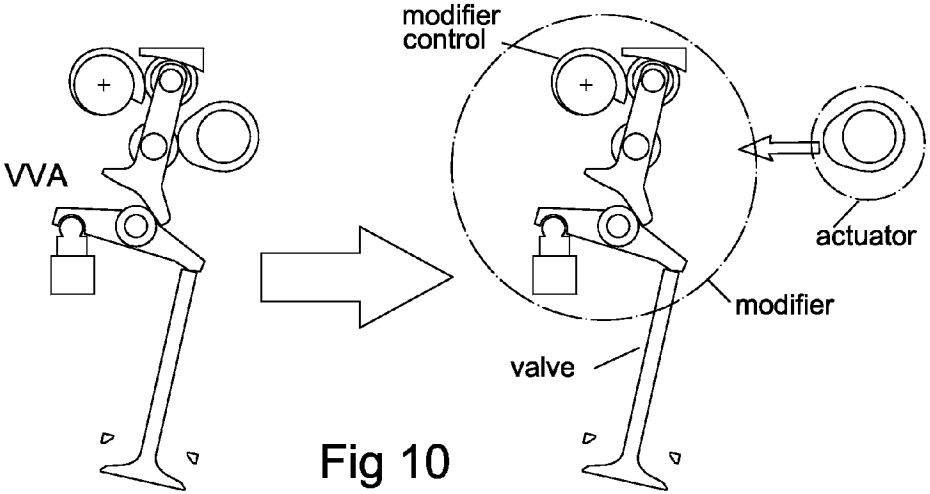
FIG. 10 shows the principle of operation of the VVA mechanism of FIG. 3.

In FIGS. 9 and 10 the flow of the 'action' from the cam to the valve is presented. The pushes from the actuator pass initially through a first modifier. Depending on the 'state' of the first modifier control, the initial pushes from the actuator are modified in amplitude or direction or duration or a combination of them, and are passed to the second modifier.

Depending on the 'state' of the second modifier control, the modified pushes are further modified and are passed to the valve. In this specific case the first modifier is of 'constant duration' while the second is of 'lost motion'.

The idea behind the modification of FIG. 4, as explained in FIGS. 9 and 10, is to feed the original LMVVA not with 'constant' pushes, like those a cam, or an eccentric pin, or a push rod etc can provide, but with 'variable' pushes. This way the LMVVA system gains, along with the angle of the original control shaft (26), one more independent variable, the angle of the control shaft (21), and the available lift-duration pairs cover not a curve on the Lift-Duration plot, but a whole area, of two dimensions.

FIG. 15 to 19 show another embodiment. As the cam lobe (2), secured on the camshaft (1), rotates, the roller (3) is displaced. The pin of the roller (3) rolls along a surface (5) of the control shaft (4), and the roller (3) rolls on the cam lobe (2). The roller (3), supported by the surface (5), displaces the roller (6). The roller (6) rolls on the roller (3) and the pin of the roller (6) rolls on a surface (8) of the control shaft (7). The roller (6) displaces, by means of rods (9), the valve actuator/lash adjuster (10), which in turn displaces the valve (11). Both control shafts (4) and (7) are rotatable about the axis at the cross (12). Changing the angles of the control shafts, the valve lift profile changes. For any specific valve lift, there are available infinite valve durations, to choose the best for the specific operational conditions.

Removing the control shaft (4) and the roller (3), and displacing properly the camshaft (1) to cooperate directly with the roller (6), as shown in FIG. 19, the result is a pure CDVVA. Such VVA is disclosed in the PCT/GR04/00043 patent application, while a working prototype is presented in details at http://www.pattakon.com/vts.

I.e. starting with a conventional CDVVA and adding a free roller like (3) per cam lobe and a 'lost motion' control shaft like (4) per row of valves, a FVVA is created. The idea behind the modification of the CDVVA to FVVA is to actuate the original CDVVA not with 'constant' pushes, like those a cam lobe, or an eccentric pin etc, can provide, but with 'modified' pushes. The CDVVA has as independent variable the angle of the control shaft, while the FVVA adds one more independent variable, the angle of the additional control shaft.

Locking the second control shaft (7) of the FVVA of FIG. 15 to 19 at its maximum lift angle, the FVVA behaves as a pure LMVVA and a set of available valve lift profiles is shown in FIG. 11. This plot is the valve lift versus the crank angle. Locking the first control shaft (4) of the same FVVA at its maximum duration angle, the FVVA behaves as a pure CDVVA and a set of available valve lift profiles is shown in FIG. 12. In FIG. 13 both sets of valve lift profiles of FIGS. 11 and 12 are shown, and the FVVA can achieve all of them, i.e. it can work with two different durations per selected lift. But the FVVA is not restricted to valve lift profiles like those shown in FIG. 13, because in the FVVA the two control shafts can change 'state' or angle independently providing not just two durations per selected lift, as in FIG. 13, but infinite durations per selected lift, as FIG. 14 shows, where the two control shafts have been rotated randomly and a few valve lift profiles have been plotted. FIG. 14 makes clear that for each valve lift, the FVVA offers a continuous range, i.e. infinite, of available valve durations, and for each valve duration the FVVA offers a continuous range, i.e. infinite, of available valve lifts.

FIG. 21 shows the FVVA mechanism of FIGS. 15 to 19 at left, and three modifications, the two middle being free from yoke roller bearings. The realization at middle-right is actually the modification to FVVA of the VVA mechanism disclosed in U.S. Pat. No. 6,892,684 patent, a working prototype of which is presented at www.pattakon.com/vva.

In PCT/GR04/00043 FIG. 16 it is shown the principle underlying the mechanism of VVA. Similarly in FIG. 20 of this application the principle underlying the FVVA mechanism is disclosed. All that is necessary is a couple of balls or rollers trapped among a valve follower, the two control surfaces and the cam, while in the VVA it takes only one control surface to trap the unique ball or roller among the valve follower, said control surface and the cam. The existence of a secondary control shaft and of additional parts seems as complication that needs be justified by the benefits the FVVA brings to the original VVA. From another point of view, the second control shaft in the FVVA of FIGS. 15 to 19 allows for the use of shorter 'cam lift' and shorter 'rod' for the same maximum valve lift, compared to the original CDVVA. The installation of restoring springs is easier. And the rotation of the constant duration control shaft (7) can be limited to an angle not requiring restoring springs other than the valve springs, for the roller (6). I.e. even in case the system is to be used as a conventional VVA, the benefits the additional control shaft brings, justify the additional complication. In any case the FVVA of FIGS. 15 to 19 uses fewer parts, per valve, than most existing VVAs, and its control surfaces (8) and (5) move slowly reducing inertia loads and increasing the rev limit.

FIGS. 22 and 23 show two CDVVAs described in PCT/GR04/00043. In FIG. 23 the side camshaft provides indirectly pushes to the VVA, through conventional push rods. In FIG. 24 the CDVVA of FIG. 23 is modified to a LMVVA by replacing the original control shaft with a lost motion one having rotation axis at the cross.

In FIG. 25 a part of the VVA of FIG. 22 and a part of the VVA of FIG. 24 are combined and form a FVVA system.

In practice the continuous change of the control shaft angle is approached by adequately small angle steps. If the construction accuracy of the CDVVA of FIG. 25 allows 100 discrete control shaft angles or modes, i.e. about one mode per 0.1 mm valve lift, and if the LMVVA of FIG. 25 can operate in another 100 discrete control shaft angles or modes, the resulting FVVA can operate not in 100+100=200 modes, but in 100*100=10,000 modes, because each step of the one control shaft angle can be combined to all 100 steps of the other control shaft angle, and each mode of the 10,000 provides a valve lift profile different from all other modes. After the above teaching, the skilled in the art can easily modify most VVA mechanisms to FVVA.

It is obvious that this application concerns not specific mechanisms but initiates a new class of mechanical VVAs.

Although the invention has been described and illustrated in detail, the spirit and scope of the present invention are to be limited only by the terms of the appended claims.

What is claimed is:

1. A variable valve actuation system for an engine comprising at least: a valve; an actuator; a first modifier mechanism, said first modifier mechanism comprises a first modifier control; a second modifier mechanism, said second modifier mechanism comprises a second modifier control; said actuator moves in synchronization to the engine and provides displacements of substantially constant profile to said first modifier mechanism, said first modifier mechanism receives said displacements of substantially constant profile, modifies them controllably, according the state of said first modifier control, into secondary displacements and provides said secondary displacements to said second modifier mechanism, said second modifier mechanism receives said secondary displacements from said first modifier mechanism, modifies said secondary displacements controllably, according the state of said second modifier control, into final displacements and provides said final displacements to said valve, the one of said modifier mechanisms can provide displacements of substantially different lift than the lift of the displacements it receives while the other one of said modifier mechanisms can provide displacements of substantially different duration than the duration of the displacements it receives.

2. A variable valve actuation system for an engine comprising at least: a valve; an actuator; a first modifier mechanism, said first modifier mechanism comprises a first modifier control; a second modifier mechanism, said second modifier mechanism comprises a second modifier control; said actuator moves in synchronization to the engine and provides displacements of substantially constant profile to said first modifier mechanism, said first modifier mechanism receives said displacements of substantially constant profile, modifies them controllably, according the state of said first modifier control, into secondary displacements and provides said secondary displacements to said second modifier mechanism, said second modifier mechanism receives said secondary displacements from said first modifier mechanism, modifies said secondary displacements controllably, according the state of said second modifier control, into final displacements and provides said final displacements to said valve, the mechanism allows the operation in at least two substantially different valve durations for a specific valve lift and the operation in at least two substantially different valve lifts for a specific valve duration.

3. A variable valve gear comprising at least: a casing; a cam (2) mounted on a camshaft (1) for rotation therewith; a valve (11); a valve actuator (9) for displacing said valve (11); an angularly displaceable, about an axis on said casing, first control surface (5); a first roller (3); an angularly displaceable, about an axis on said casing, second control surface (8); a second roller (6); characterized in that: the first roller (3) is arranged among the cam (2), the first control surface (5) and the second roller (6) in substantially simultaneous abutment with all three of them; the second roller (6) is arranged among the second control surface (8), the first roller (3) and the valve actuator (9) in substantially simultaneous abutment with all three of them; the first roller (3) is displaced along the first control surface (5) under the camming action of the cam (2); the second roller (6) is displaced along the second control surface (8) under the action of the first roller (3); the valve actuator (9) is displaced by the second roller (6); and the valve (II) is displaced by the valve actuator (9) at a stroke of variable lift and variable duration depending on both, the angular displacement of the first control surface (5) and the angular displacement of the second control surface (8).

4. As in claim 3 characterized in that the rollers are substantially free rollers trapped among the cam (2), the control surfaces (5) and (8) and the valve actuator (9).

* * * * *